United States Patent [19]

Hale

[11] 4,025,112

[45] May 24, 1977

[54] MEDICAL STOOLS

[76] Inventor: Dean H. Hale, 2500 N. Main St., Logan, Utah 84321

[22] Filed: Dec. 15, 1975

[21] Appl. No.: 640,823

[52] U.S. Cl. ..... 297/411; 297/194

[51] Int. Cl.[2] ..... A47C 7/54

[58] Field of Search ..... 403/84, 165, 334, 361; 248/282, 289, 286, 415, 418; 297/411, 417, 194

[56] References Cited

UNITED STATES PATENTS

| | | | |
|---|---|---|---|
| 743,279 | 11/1903 | Haycock | 16/168 |
| 1,032,801 | 7/1912 | Allingham | 248/282 X |
| 2,164,390 | 7/1939 | Dickerson | 248/282 |
| 2,950,892 | 8/1960 | Rick | 248/282 |
| 3,338,600 | 8/1967 | Wahl | 403/361 X |
| 3,348,799 | 10/1967 | Junkel et al. | 312/209 X |
| 3,829,159 | 8/1974 | Leffler | 297/417 |

FOREIGN PATENTS OR APPLICATIONS

| | | | |
|---|---|---|---|
| 424,192 | 5/1967 | Switzerland | 403/334 |

*Primary Examiner*—James T. McCall
*Attorney, Agent, or Firm*—Lynn G. Foster

[57] ABSTRACT

A stool for medical and other purposes, the stool comprising a base with or without casters, a seat, vertical support frame or structure between the base and the underside of the seat, which may contain structure for varying the effective height thereof, body rest structure eccentrically disposed above and adjacent part of the periphery of the seat with support frame spanning and transferring load between the body rest structure and the underside of the seat and/or the vertical support structure between the underside of the seat and the base, which last-mentioned support frame may comprise structure for vertically altering the location of the body rest structure. The stool also comprises a load-bearing member such as an arm rest or a combination arm rest equipment holding platform or merely an equipment holding platform, the arm rest or platform being selectively positionable in any one of a plurality of support or work locations adjacent the body rest structure, the arm rest or equipment support being connected by an intermediate generally horizontally disposed member which is joined to the support frame and the underside of the arm rest or equipment support, respectively, by male/female tapered connectors which, when the male/female interrelationship is compressed, ready rotation at the connector is obviated whereas the opposite is true when the male/female relationship is caused to be relatively loose, the connectors accommodating ready separation of the arm rest from the intermediate member and the intermediate member from the support frame.

8 Claims, 4 Drawing Figures

MEDICAL STOOLS

BACKGROUND

1. Field of Invention

The present invention relates generally to stools and more particularly to novel connectors or mountings for stool load-bearing arm rests and/or equipment supports.

2. Prior Art

In the past, it has been the practice to provide in conjunction with medical and like stools a body rest against which the patient or user rests his or her stomach or back and arm rests or equipment supports which are pivotally mounted so that they may be selectively located to suit the needs of the patient or user and the physician, dentist or the like. This particular stool arrangement has resulted in a perpetual problem respecting the pivotal connectors heretofore interposed between the arm rest or equipment support and the frame. More specifically, such pivotal connectors typically are either too tight or too loose, being too tight when the parts are mechanically tightened with bolts or the like and too loose when the bolts work loose after a few rotations, resulting in arm instability after a short period of use.

BRIEF SUMMARY AND OBJECTS OF THE INVENTION

In summary, the present invention comprises novel connector structure interposed between an arm rest or equipment support and the frame work of a stool which may be used for medical, dental or other purposes wherein said connectors are tapered male/female telescopically related fittings which accommodate axial variation in the distance of male/female telescopic overlap wherein the ease with which the arm rest or the like may be pivoted can be instantaneously varied without tools and wherein the arm rest may be physically substantially locked in a selected position without the requirement of loosening or tightening fittings, bolts or component parts with wrenches, etc.

In light of the foregoing, it is a primary object of the present invention to provide a novel improved stool.

It is a further principal object of the present invention to provide a stool with a displaceable load-bearing arm rest or equipment support pivotally joined to the framework of the stool by a novel male/female telescopic connector which accommodates varying resistances to rotation without requiring frequent or complicated adjustments.

These and other objects and features of the present invention will be apparent from the following detailed description, taken with reference to the accompanying drawings.

DETAILED DESCRIPTION OF ILLUSTRATED EMBODIMENT

Figure 1:
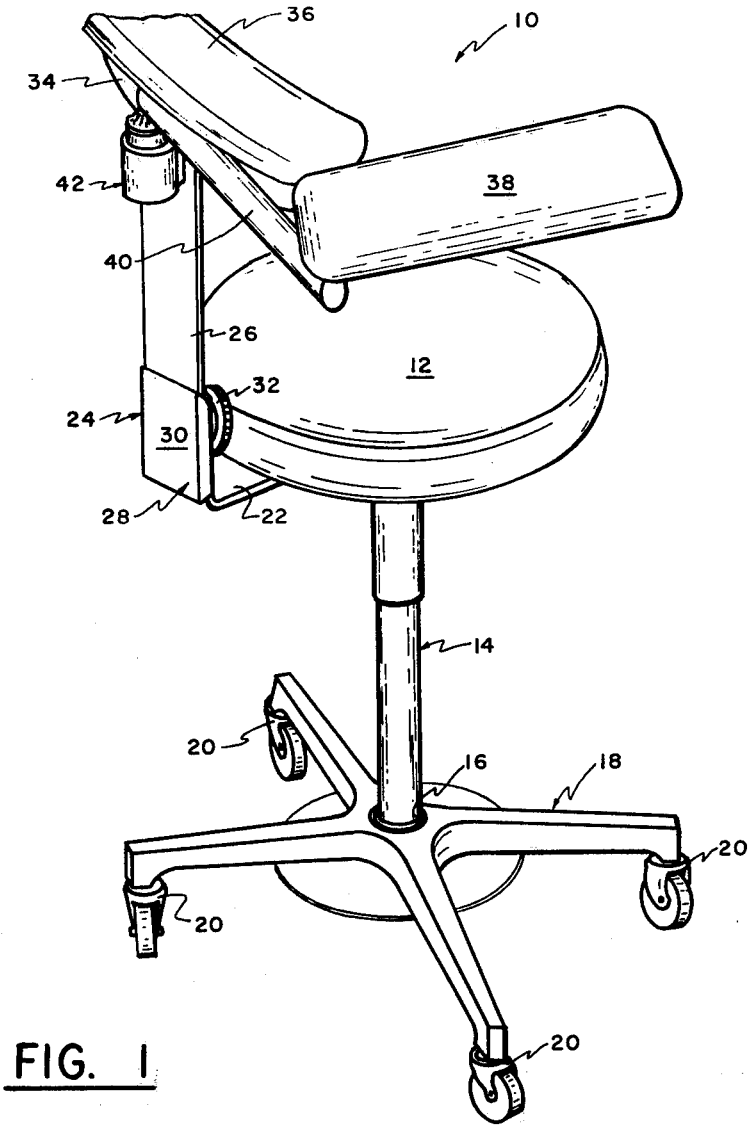
FIG. 1 is a perspective representation of a stool fabricated to incorporate the present invention.

Reference is now made to the drawings wherein like numerals are used to designate like parts throughout, the drawings, particularly in FIG. 1, illustrating a stool for medical, dental or other purposes, generally designated 10. A substantial part of the stool 10 is conventional and no lengthy description thereof is deemed to be necessary. The stool comprises a seat 12 where a patient or user is seated, the seat typically having a base or underside (not shown) to which a support structure 14, comprising part of the framework of the stool, is connected at its upper end. The support structure 14 may in fact comprise a device for varying the height of the seat 12 above the floor. For example, the support structure 14 may comprise the power unit illustrated and described in the Inventor's prior U.S. Pat. No. 3,636,816, which issued Jan. 25, 1972.

The lower end of the seat support structure 14 is connected conventionally at site 16 to a base 18 which is also conventional and which is illustrated as being carried upon floor engaging casters 20. The top portion of the seat support structure 14, or, alternatively, the underside of the seat carries an L-shaped arm 22 which comprises part of a body rest support frame 24 (part of the framework) and is illustrated as comprising flat spring steel stock, which will flex a predetermined distance under load. The substantially horizontally directed arm 22 is coupled to a vertical plate also comprising part of the body rest support frame 24 and likewise illustrated as comprising flat spring steel stock, the arm 22 and vertical plate 26 being united by an adjustable connector 28 comprising a rectangular collar 30 and a manual screw adjustment handle 32 of well known conventional configuration wherein the handle 32 may be loosened to vary the vertical position of the plate 26 and tightened once the plate 26 has been appropriately located.

The upper end of the vertical plate 26 is welded or otherwise appropriately connected to a crosspiece 34 which is also preferably metal and comprises part of the body rest support frame 24. The body rest 36, which is preferably cushioned and upholstered, is mounted across the top of transverse frame member 34 in a conventional fashion.

One or more load-bearing arm rests 38, preferably also cushioned and upholstered, which may alternatively comprise an equipment support platform or the like, are carried by the framework of the stool 10, preferably by body rest support frame 24, each arm rest or equipment support platform being carried by an intermediate, horizontally disposed, load transferring cantilevered beam member 40 which is pivotally or rotatably joined to the underside of the arm rest or equipment support platform 38, at any location, by a tapered male/female telescopic connector 42 and to the framework of the stool, preferably body rest support frame 24, at any location thereon, by the identical, though inverted, tapered male/female pivotal telescopic connector 42. If desired, only one of said two connectors may be used.

Figure 2:
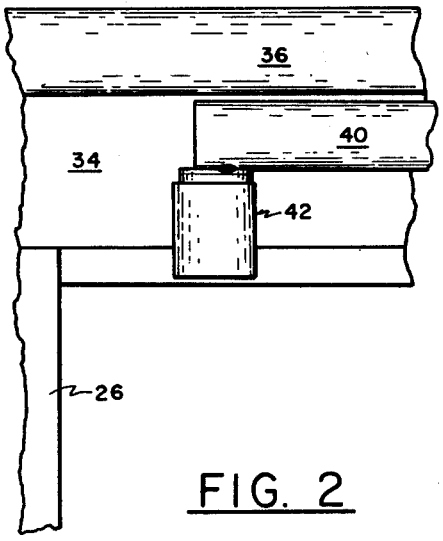
FIG. 2 is a fragmentary enlarged elevational view of the body rest of the stool of FIG. 1 particularly illustrating the connector between an arm rest support and the framework which supports the body rest.
Figure 3:
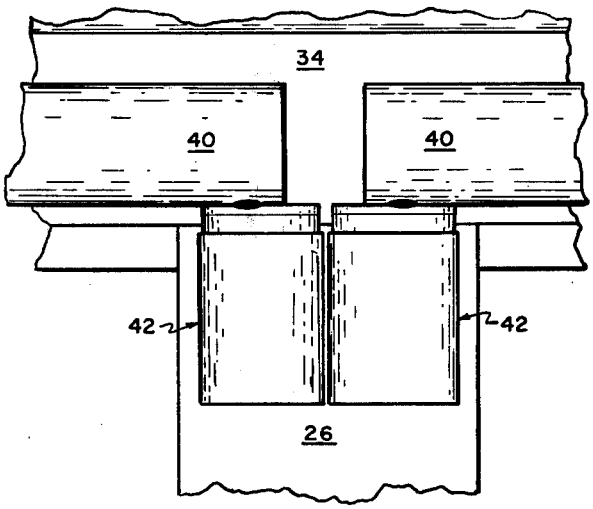
FIG. 3 is an enlarged fragmentary elevational view similar to FIG. 2 illustrating opposed horizontal supports for two arm rests and centrally disposed male/female connectors for each.
Figure 4:
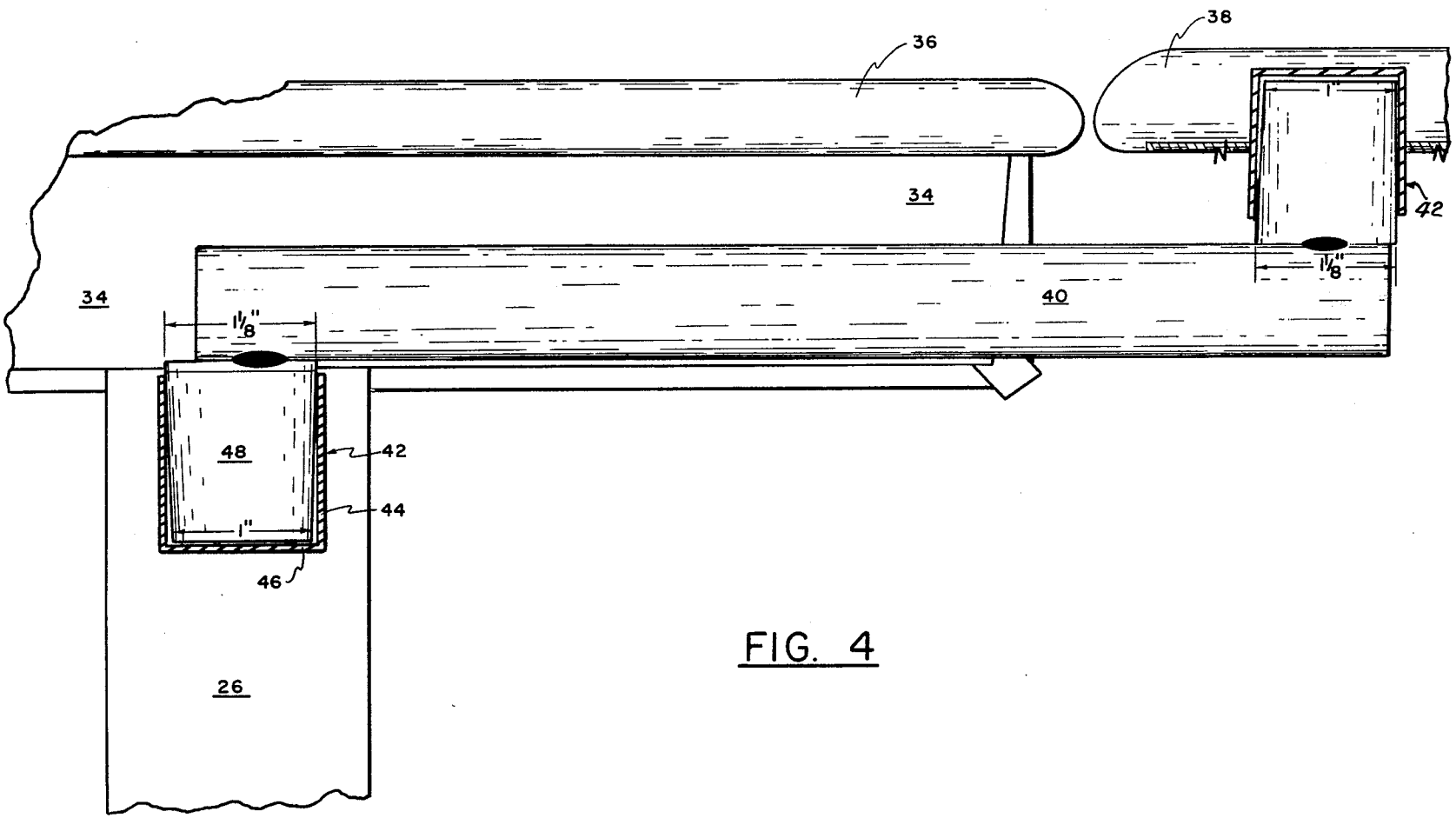
FIG. 4 is an enlarged fragmentary elevational view showing a typical horizontal intermediate support for an arm rest and further illustrating in cross section the tapered male/female telescopic connector joining the horizontal intermediate support member to the central body rest support frame and the tapered male/female telescopic connector joining the opposite end of the intermediate horizontal support member to the arm rest per se.

For purposes of illustrating the scope of the present invention, reference is particularly made to FIGS. 2–4 which illustrate several of the possible mounting sites for interposing connector 42 between the framework and the beam 40, i.e. (1) using a single load transferring beam and an eccentric welded site (FIG. 2), (2) using two load transferring beams 40 and two arm rests or equipment support platforms with the respective connectors 42 between the framework and the two beams 40 being centrally welded in an elevated location to the plate 26 of the body rest support frame 24 (FIG. 3) and (3) a single arm 40 with a single connector 42 interposed between the beam 40 and the plate 26 at an elevated central substantially concentric position. In like fashion, it is to be appreciated that the interposition of inverted connector 42 between the distal end of each beam 40 and an associated arm rest 38 or equipment support platform may be disposed anywhere along the arm rest or equipment support platform.

Each male/female telescopic connector 42 comprises, as illustrated, a U-shaped cylindrical cup 44 of predetermined and uniform diameter throughout, the ends away from the beam 40, which is illustrated as being cylindrical but may be of any desired structural shape, is shown to be closed by an end plate 46. The female cup is open at the opposite end and receives a male truncated conical projection 48, the exterior of which tapers in the direction of wall 46 of the female cup 44, the diameter of the male projection 48 varying from a minimum *dm* at the distal end which is less than the interior diameter of the female cup 48 to a maximum diameter *dx* which is greater than the inside diameter of the female cup 28, the taper on the exterior of the male projection 48 being preferably on the order of 1 percent. A female cup 44 of each male/female connector 42 is welded, respectively, to the framework such as plate 26 (FIG. 4) and to the underside of the arm rest 38 or equipment support platform in a fixed rigid disposition. Each male projection 48 is welded at its proximal end to the adjacent end of the beam 40.

In use, with the arm rest 38 and the associated beam 40 removed from the remainder of the assembly, the beam 40 is joined to the assembly by merely placing the male projection 48 attached to the proximal end downward into the female cup 44 of the connector 42 which is attached to the framework of the stool. If the resultant telescopic union between the male projection 48 and the female cup 44 is relatively loose, the beam 40 may be pivoted at said connector 42 with considerable ease. To the contrary, if substantial vertical force is applied so as to foreshorten the telescopic engagement between the mentioned male projection 48 and female cup 44, rotation at said connection 42 becomes progressively more difficult as the telescopic overlap is foreshortened. By forcing the male projection 48 into the female cup 44 the maximum distance, rotation can be substantially precluded.

The arm rest 38 is then mounted to the distal end of the beam 40 by placing the inverted female cup 44 attached to the arm rest 38 downwardly upon the male projection 48 of the connector 42 located at the distal end of the beam 40. Again, rotation of the arm rest in respect to the last-mentioned connector 42 is dependent upon the amount of telescopic engagement between the male projection 48 and female cup 44, which is controlled by the operator by exerting sufficient manual force to vertically adjust the telescopic overlap (up or down) sufficient to produce the desired degree of rotation or prevent rotation as the case may be.

It is to be appreciated that typically the pivotal relationship between the two connectors 42 and the associated beam 40 of any arm rest, is initially maintained in a relatively loose condition until the arm rest (or equipment support platform) is placed in the desired position, body rest 36 either supporting the stomach or the back of the user depending upon the orientation desired by the operator. Once the arm rest or its equivalent has been placed as desired by the operator, downward pressure on the beam 40 above the framework supported connector 42, if of a sufficient magnitude, will preclude rotation of one connector as will downward force exerted upon the associated arm rest 38 as to the other connector. If it is desired to reposition the arm rest 38 or equipment support platform, a gentle lifting force on the arm 38 and the beam 40 will restore the desired rotational capability.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A stool comprising:

a seat;

framework means connected to and supporting the seat;

horizontally disposed means for supporting a load comprising an arm of the user, equipment or the like;

variable resistance pivotal connector means interposed between the framework means and the supporting means, the connector means comprising telescopically interrelated male and female means, at least one of said telescopically interrelated male and female means being relatively tapered in respect to the other, so that the amount of telescopic overlap may be selectively varied manually with minimum effort and no tools, which in turn will vary the resistance to relative rotation of the male and female means to accommodate ready rotation of the supporting means from position to position or retention in a selected position in respect to the framework means.

2. A stool according to claim 1 wherein said supporting means comprise a load-bearing arm rest or equipment support platform together with load transferring beam means connected to the arm rest or equipment platform and further comprising a second of said connector means interposed between the arm rest or equipment platform and beam means.

3. A stool according to claim 1 wherein the angle of said relative taper is on the order of 1°.

4. A stool according to claim 1 wherein the female means of the connector means has a cylindrically hollow interior and the male means has a limited convergent conical taper in a direction toward the female means.

5. A stool according to claim 1 wherein the connector means is located above the seat adjacent the periphery of the seat.

6. A stool according to claim 1 wherein said framework means extends eccentrically above the seat adjacent the periphery of the seat and the connector means are eccentrically joined to the framework means above the seat adjacent the periphery of the seat.

7. A stool according to claim 1 wherein the framework means extends eccentrically above the seat adjacent the periphery of the seat and the connector means are substantially concentrically joined to the framework means above the seat adjacent the periphery of the seat.

8. A stool according to claim 1 wherein said supporting means comprises a load-bearing arm rest or equipment support and said connector means are located at the underside of said arm rest or equipment support.

* * * * *